US007735931B1

(12) United States Patent
Weiner et al.

(10) Patent No.: US 7,735,931 B1
(45) Date of Patent: Jun. 15, 2010

(54) PORTABLE CHAIR APPARATUS

(76) Inventors: Steven L. Weiner, 101 Mystic Pl., Alamo, CA (US) 94507; Leonard L. Hofheins, 1137 N. 1450 East, Provo, UT (US) 84604

( * ) Notice: Subject to any disclaimer, the term of this patent is extended or adjusted under 35 U.S.C. 154(b) by 0 days.

(21) Appl. No.: 12/316,847

(22) Filed: Dec. 17, 2008

Related U.S. Application Data

(60) Provisional application No. 61/008,223, filed on Dec. 19, 2007.

(51) Int. Cl.
*A47C 7/02* (2006.01)
*A47C 7/62* (2006.01)

(52) U.S. Cl. ..... 297/452.41; 297/DIG. 3; 297/188.04

(58) Field of Classification Search ..... 297/452.41, 297/17, 188.04, 188.09, DIG. 3, 188.01
See application file for complete search history.

(56) References Cited

U.S. PATENT DOCUMENTS

| | | | | |
|---|---|---|---|---|
| 3,408,107 | A * | 10/1968 | Savage | 297/452.41 |
| 5,947,563 | A * | 9/1999 | Klimenko | 297/452.41 |
| 6,199,946 | B1 * | 3/2001 | Connor, Jr. | 297/181 |
| 6,421,852 | B1 * | 7/2002 | Shao | 5/413 R |
| 6,799,339 | B2 * | 10/2004 | Stewart | 5/413 AM |
| 6,951,039 | B2 * | 10/2005 | Roseff | 5/706 |
| 2002/0101099 | A1 * | 8/2002 | Hughes | 297/181 |
| 2002/0133879 | A1 * | 9/2002 | Smith et al. | 5/413 R |

* cited by examiner

*Primary Examiner*—Milton Nelson, Jr.
(74) *Attorney, Agent, or Firm*—Thomas R. Lampe

(57) ABSTRACT

Portable chair apparatus includes a hollow, collapsible chair and a receptacle attached to the chair for containing the chair when it is in collapsed condition. An electrically operated air pump is used to alternatively inflate or deflate the chair.

10 Claims, 6 Drawing Sheets

PORTABLE CHAIR APPARATUS

This application is based on and claims the benefit of Provisional Patent Application No. 61/008,223, filed Dec. 19, 2007.

TECHNICAL FIELD

This invention relates to portable chair apparatus including a chair that is selectively either inflated by a pump or quickly deflated to a collapsed condition for retention in a receptacle attached to the chair.

BACKGROUND OF THE INVENTION

Collapsible chairs per se are known, including chairs which may be inflated by a pump or lung power. Often, however, such chairs are not convenient to use or are not suitable for transport from one location to another, even in a collapsed condition.

DISCLOSURE OF INVENTION

The chair apparatus of the present invention incorporates a number of features which make it particularly useful for transport in collapsed condition and quick inflation of the chair at a site of use. The chair apparatus is suitable for use virtually anywhere a person needs a chair, for example in airports, sporting events and concerts, or while waiting in line.

The portable chair apparatus of the invention includes a hollow, collapsible chair formed of flexible material and defining a chair interior. The chair alternately is in an inflated condition or a collapsed condition. The chair when in the inflated condition has pressurized air in the chair interior and forms a chair seat capable of supporting a seated individual.

A receptacle is attached to the chair, the receptacle for receiving and accommodating the chair when the chair is in collapsed condition.

The portable chair apparatus additionally includes an air pump attached to the chair for introducing air into the chair interior to inflate the chair whereby the chair attains the inflated condition.

Other features, advantages and objects of the present invention will become apparent with reference to the following description and accompanying drawings.

BEST MODE FOR CARRYING OUT THE INVENTION

Figure 1:
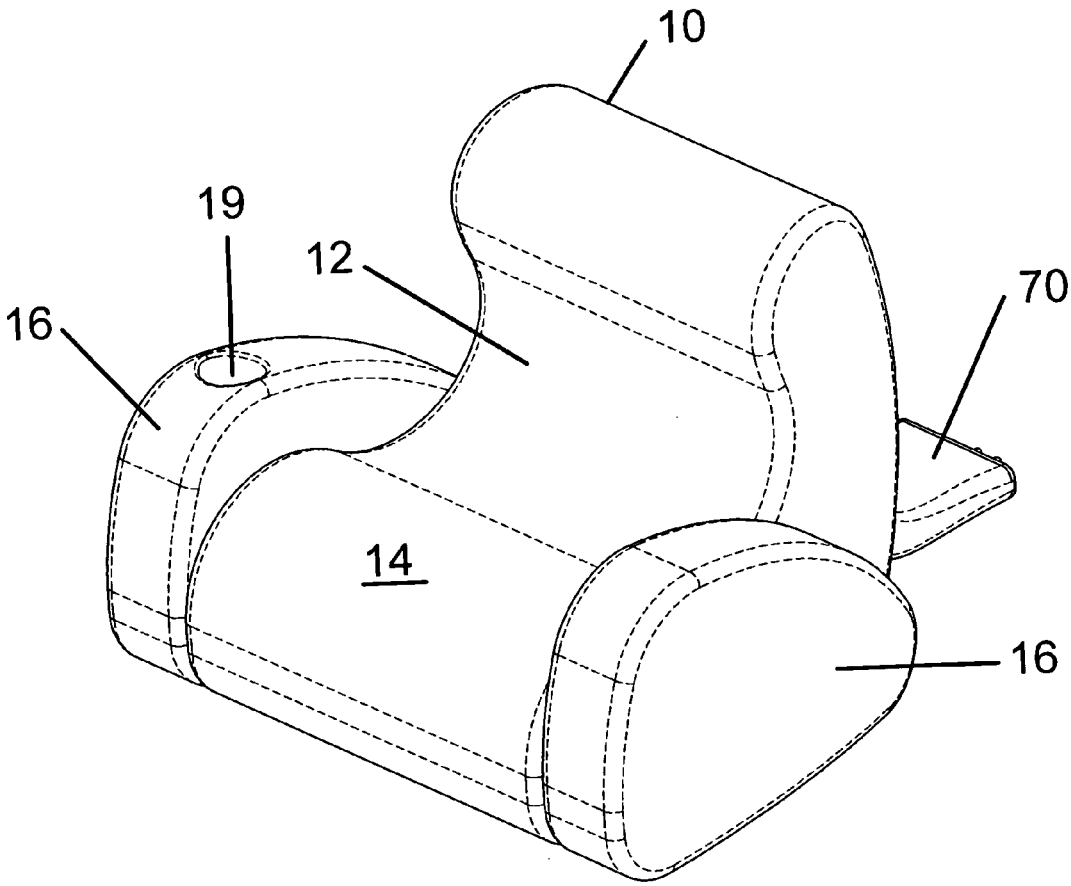
FIG. 1 is a front, perspective view of portable chair apparatus constructed in accordance with the teachings of the present invention, with the chair in inflated condition and ready for use by an individual.
Figure 2:
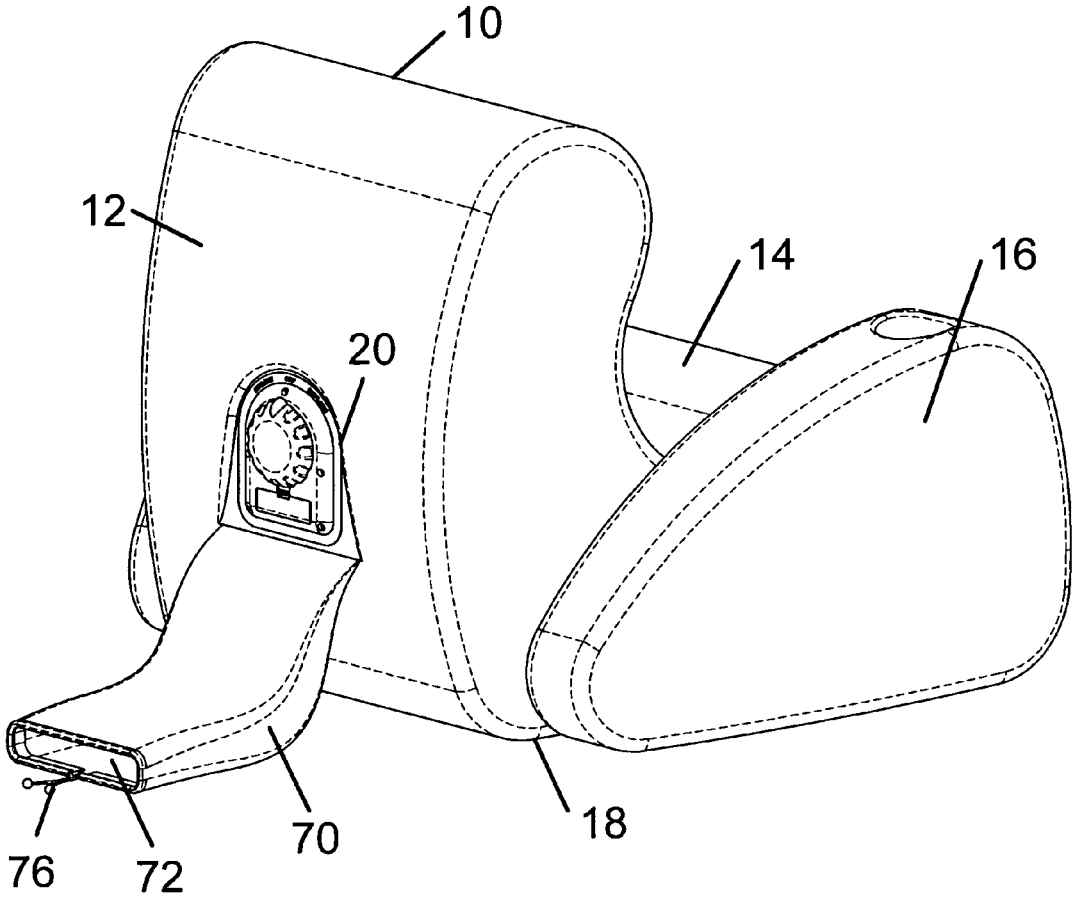
FIG. 2 is a rear, perspective view of the inflated chair illustrating an air pump located on the chair back and an empty storage receptacle depending from the chair back.

Referring now to the drawings, a preferred mode of the chair apparatus constructed in accordance with the teachings of the present invention includes a chair 10 having a chair back 12, a chair seat 14, and two side arms 16. The chair seat, the chair back and the chair side arms are configured to provide a comfortable seating arrangement when the chair is inflated as shown in the drawings.

The chair back 12, the chair seat 14, and the chair side arms 16 are all hollow and the interiors thereof are in communication so that the chair may be inflated to the illustrated inflated condition or deflated to provide a collapsed or deflated condition from a single location on the chair.

The chair seat 14 has a flat bottom 18 which allows the chair to be stably positioned on any flat surface, including floors, platforms, the ground, etc. The chair back, chair seat and chair side arms are formed of strong, flexible, air impermeable plastic sheet material of any suitable type, such as vinyl. A cup holder 19 is formed in a chair side arm.

Positioned at the rear surface of the chair back 12 is an air pump 20 as will be described in greater detail below. The air pump is electrically operated and may be utilized to either place the chair in inflated condition or assist in deflating the chair to a collapsed condition.

Figure 3:
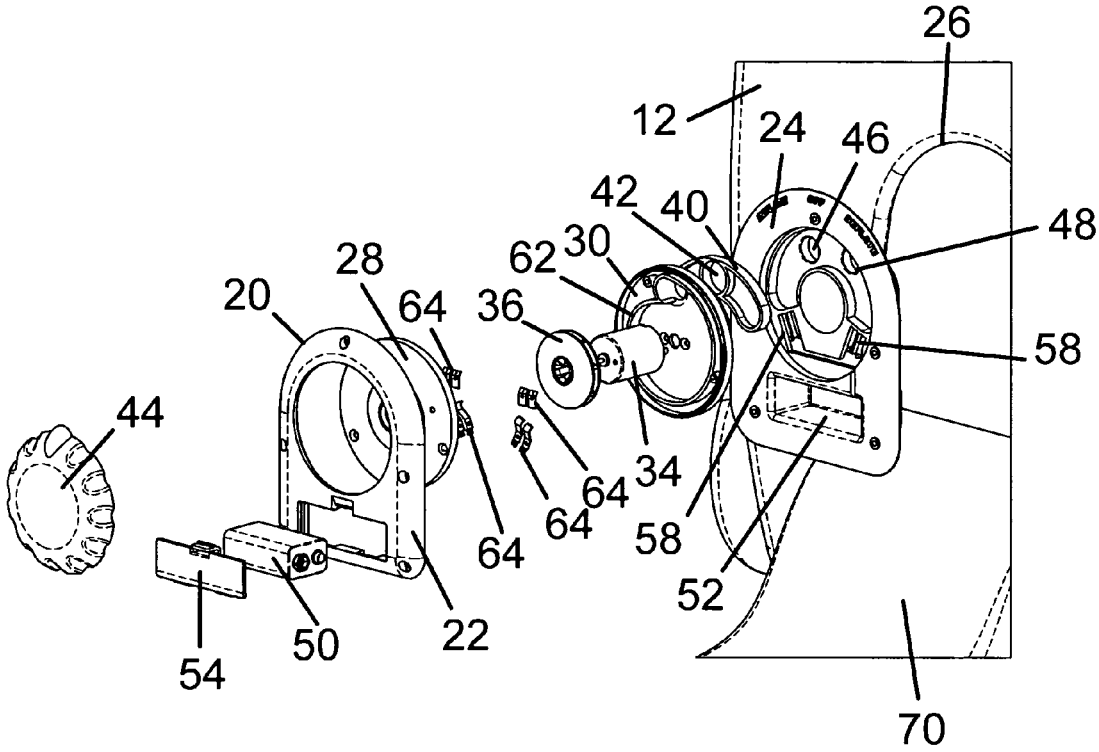
FIG. 3 is an exploded, perspective view illustrating a portion of the chair back and components of the air pump.
Figure 4:
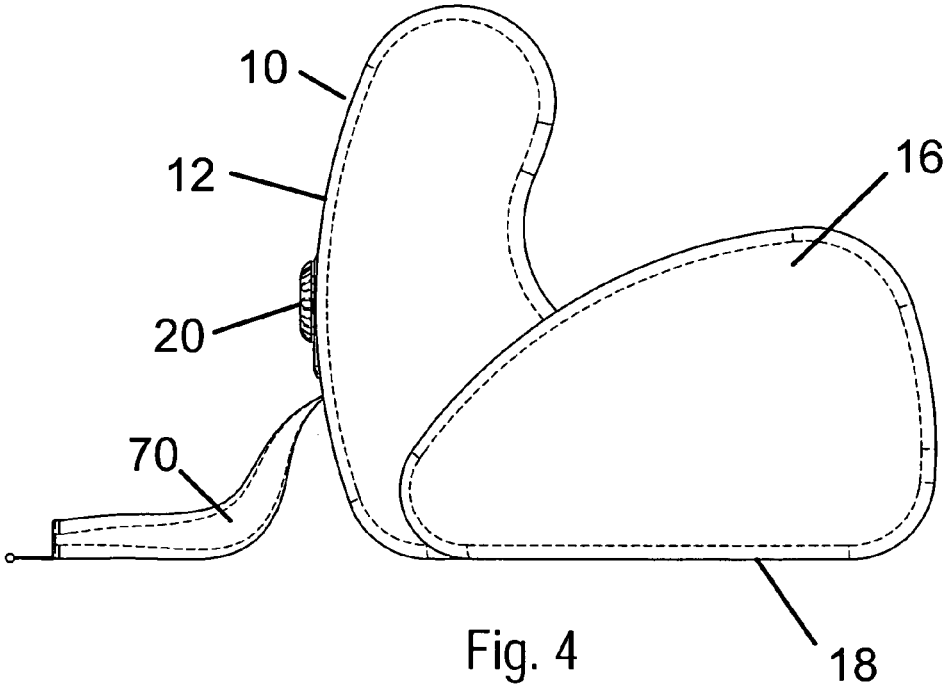
FIG. 4 is a side, elevational view of the apparatus, the chair being in inflated condition.
Figure 5:
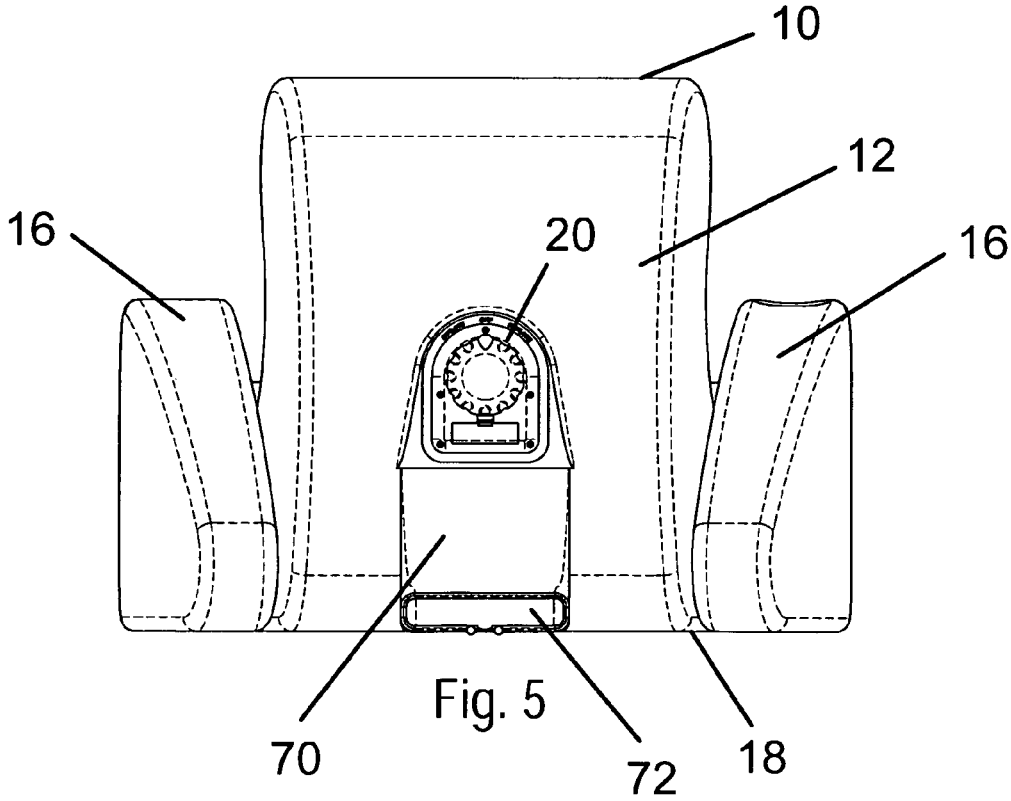
FIG. 5 is a rear, elevational view of the chair apparatus, the chair being in inflated condition.
Figure 6:
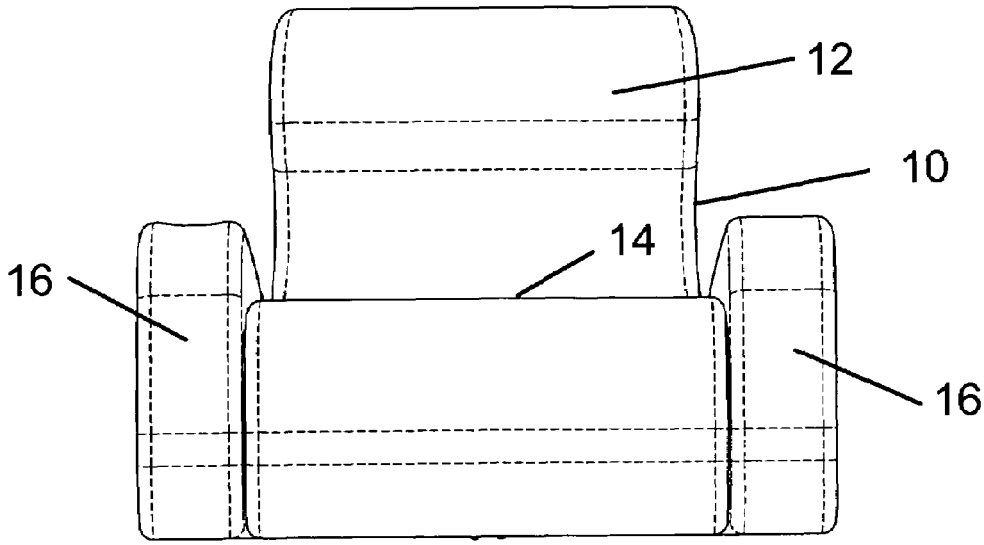
FIG. 6 is a front, elevational view of the apparatus, the chair being in inflated condition.
Figure 7:
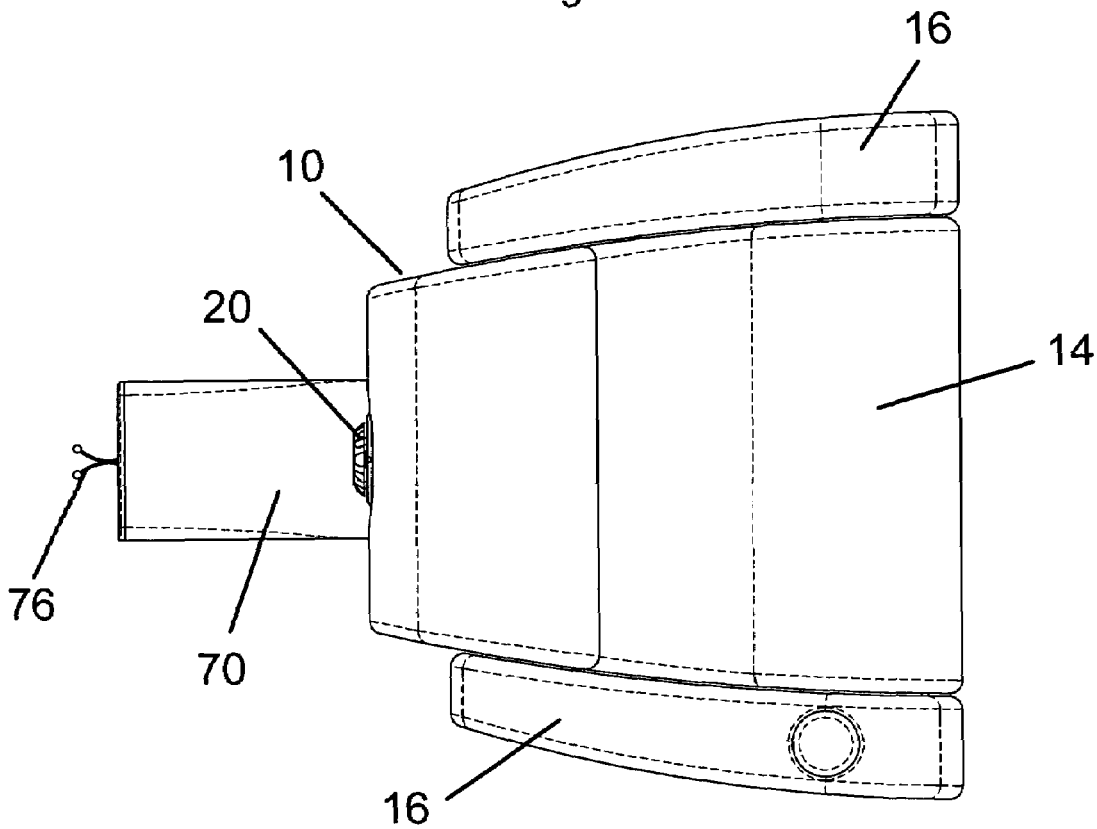
FIG. 7 is a top, plan view of the chair apparatus, the chair being in inflated condition.

Components of the air pump 20 are illustrated in FIG. 3 which shows the air pump prior to its assembly and attachment to the chair back 12. Air pump 20 includes an outer housing member 22 and an inner housing member or base 24, the latter being affixed to the chair back by any known expedient and covering a hole 26 in the chair back. A first fan housing member 28 is connected to outer housing member 22 and is connected by any suitable fasteners to a second fan housing member 30.

A DC motor 34 is attached to the second fan housing member 30, the DC motor driving a blower impeller fan 36. When the fan housing members 28 and 30 are connected, the fan and motor are disposed within the confines thereof.

Attached to the back of fan housing member 30 and is an air flow control valve 40 defining an opening 42 in air flow communication with the interior defined by the connected fan housing members and with blower impeller fan 36. The assembly comprising the fan housing members 28, 30, the blower impeller fan 36, the DC motor 34 and the air flow control valve 40 are rotatable as a unit relative to the outer housing member 22 and the inner housing member 24, such rotation being caused by rotation of a manually graspable control knob or handle 44 connected to the assembly.

Base or inner housing member 24 has two openings 46, 48 formed therein which are in communication with the interior of the chair 10. Opening 46 is an air supply opening and opening 48 is an air vent opening. When the opening 42 formed in air flow control valve 40 is aligned with air supply opening 46, the DC motor rotates the fan 36 in a direction which will draw ambient air around the control knob 44, through outer housing member 22 and into the fan housing interior defined by the fan housing members 28, 30. Air will be directed through the opening 42 of the air flow control valve and into the interior of the chair through air supply opening 46.

When the assembly comprising the fan housing members, the DC motor, the blower impeller fan and the air flow control valve are rotated to a second position wherein the opening 42 is over air vent opening 48, the polarization of the DC motor is reversed and air within the chair interior is vented or drawn outwardly through vent opening 48, the interior of the attached fan housing members and out through the outer housing member 22 about knob or handle 44.

The assembly may also be rotated to a third position by knob 44 wherein the opening 42 of air flow control valve 40 is located between the air supply opening and the air vent opening. When the assembly is in this position, pressurized air remains sealed in the chair interior and the DC motor and blower impeller fan will be inoperative.

In the arrangement illustrated, the blower impeller is electrically powered by a battery 50 disposed within a compartment 52 in base 24. A battery cover 54 is connected to the outer housing member 22 to cover the battery. The battery is connected to electrical contacts 58 which are installed in the base. The electrical wiring 62 of the DC motor is operatively associated with electrical contacts 64 associated with the fan housing member 28 brought into engagement with the electrical contacts 58 upon rotation of the control knob in such a manner as to reverse polarity of the DC motor and reverse fan rotation as described above to either pressurize or vent the chair.

Figure 8:
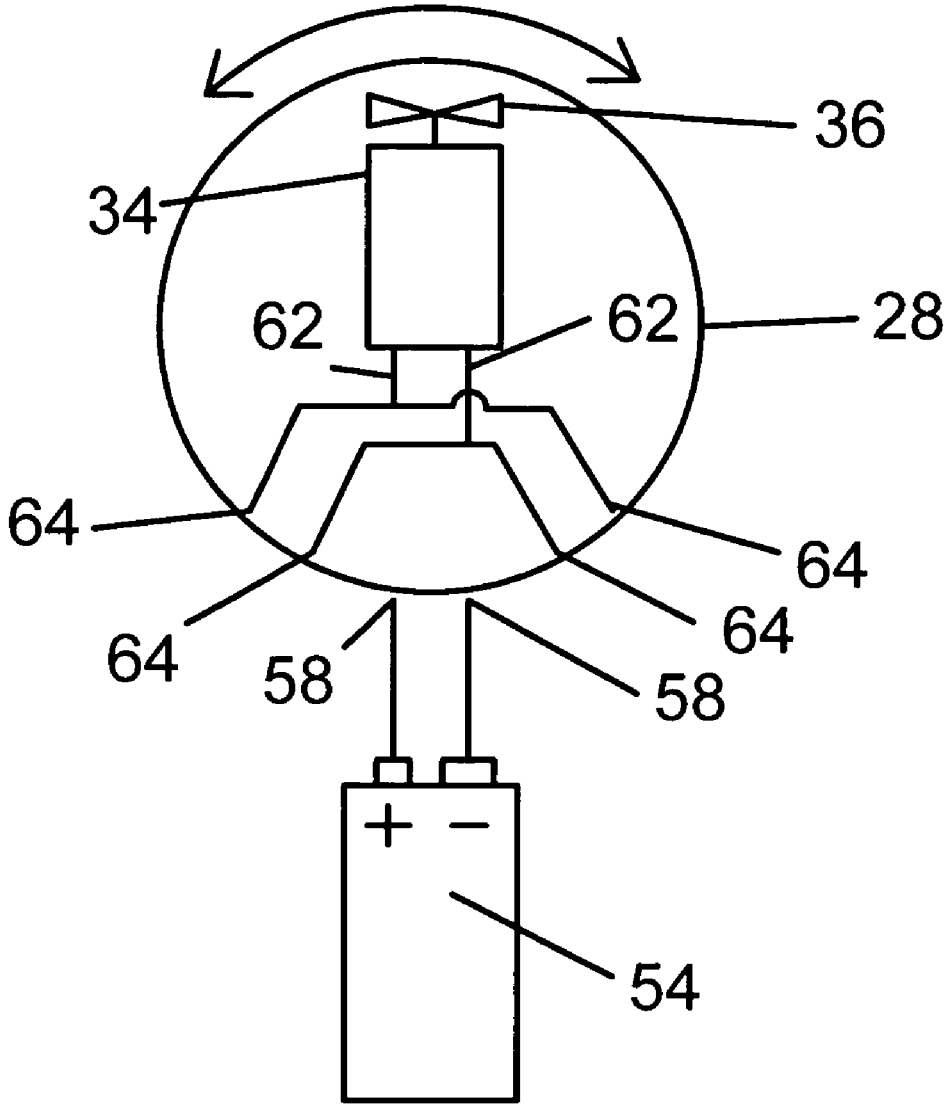
FIG. 8 is an electrical schematic diagram showing components of the apparatus relating to operation of the air pump.

FIG. 8 is an electrical schematic diagram showing battery 54 leading to electrical contacts 58. Rotation of the housing member 28 in one direction by the control knob will cause contacts 58 to engage one set of contacts 64 to energize the motor to rotate the fan in one direction, and rotation of the housing member 28 in the opposite direction will cause contacts 58 to engage the other set of contacts 64 to reverse the polarity of the motor and cause it to reverse rotation direction of the fan. When the components are positioned as shown in FIG. 8 (the third position indicated above) the motor is deenergized so that the fan does not cause air flow when the opening 42 of the air flow control valve 40 is located between the air supply opening and the air vent opening.

Another aspect of the invention is the attachment of a bag-like receptacle 70 to the chair, in the disclosed embodiment to the chair back closely adjacent to the electrical blower impeller. The receptacle defines a receptacle opening 72 at one end. When the chair is in collapsed condition the receptacle is inverted and the collapsed chair and air pump are positioned into the interior of the receptacle through the receptacle opening. A pull string closure 76 is utilized to selectively open or close the receptacle opening.

The invention claimed is:

1. Portable chair apparatus comprising, in combination:

a hollow, collapsible chair formed of flexible material and defining a chair interior, said chair alternatively in an inflated condition or a collapsed condition, said chair when in said inflated condition having pressurized air in said chair interior and forming a chair seat capable of supporting a seated individual;

a receptacle attached to said chair, said receptacle for receiving and accommodating said chair when said chair is in collapsed condition; and an air pump attached to said chair for introducing air into said chair interior to inflate said chair whereby said chair attains said inflated condition, said air pump including an electrically operated blower impeller mounted within a housing attached to said chair, said housing having an air supply opening in communication with said chair interior for introducing air from said blower impeller into said chair interior.

2. The portable chair apparatus according to claim 1 wherein said receptacle defines a receptacle opening through which the chair is introduced into said receptacle when the chair is in collapsed condition.

3. The portable chair apparatus according to claim 2 including a receptacle closure connected to said receptacle for selectively opening or closing said receptacle opening.

4. The portable chair apparatus according to claim 1 wherein said housing additionally has an air vent opening in communication with said chair interior for venting air from said chair interior.

5. The portable chair apparatus according to claim 4 additionally comprising an air flow control valve operatively associated with said housing to control air flow through said air supply opening and said vent opening.

6. The portable chair apparatus according to claim 5 additionally comprising switch structure operatively associated with said electrically operated blower impeller and said air flow control valve for reversing said electrically operated blower impeller whereby said electrically operated blower impeller blows air into said chair interior when said air flow control valve establishes air flow communication between said blower impeller and said chair interior through said air supply opening and whereby said electrically operated blower impeller draws air from said chair interior when said air flow control valve establishes air flow communication between said blower impeller and said chair interior through said vent opening.

7. The portable chair apparatus according to claim 6 wherein said air flow control valve is selectively movable between first, second and third positions, said air flow control valve when in said first position closing said vent opening and establishing air flow communication between said blower impeller and said chair interior through said air supply opening, said air flow control valve when in said second position closing said air supply opening and establishing air flow communication between said blower impeller and said chair interior through said vent opening, and said air flow control valve when in said third position closing both said air supply opening and said vent opening, said switch structure operable to terminate operation of said blower impeller when said air flow control valves moves to said third position.

8. The portable chair apparatus according to claim 7 additionally including a manually operable control for moving said air flow control valve between said first, second and third positions.

9. The portable chair apparatus according to claim 7 wherein said electrically operated blower impeller includes a DC motor driving a fan, said switch structure operable to reverse polarity of said DC motor and cause rotation of said fan to reverse when said air flow control valve moves between said first position and said second position.

10. The portable chair apparatus according to claim 9 wherein said switch structure is operable to deenergize the DC motor when the air flow control valve is in said third position.

* * * * *